US006093007A

United States Patent [19]

Shaw

[11] Patent Number: 6,093,007

[45] **Date of Patent: *Jul. 25, 2000**

[54] MULTI-ROTOR HELICAL-SCREW COMPRESSOR WITH THRUST BALANCE DEVICE

[76] Inventor: David N. Shaw, 200 D Brittany Farms Rd., New Britain, Conn. 06053

[ * ] Notice: This patent issued on a continued prosecution application filed under 37 CFR 1.53(d), and is subject to the twenty year patent term provisions of 35 U.S.C. 154(a)(2).

[21] Appl. No.: 09/006,420

[22] Filed: Jan. 13, 1998

Related U.S. Application Data

[63] Continuation-in-part of application No. 08/808,470, Mar. 3, 1997, Pat. No. 5,807,091, which is a continuation of application No. 08/550,253, Oct. 30, 1995, Pat. No. 5,642,992.

[51] Int. Cl.[7] ..... F04C 18/16

[52] U.S. Cl. ..... 418/197; 418/203

[58] Field of Search ..... 418/197, 203; 417/410.4

[56] References Cited

U.S. PATENT DOCUMENTS

| | | | |
|---|---|---|---|
| 2,095,167 | 10/1937 | Burghauser | 418/203 |
| 2,481,527 | 9/1949 | Nilsson | 418/197 |
| 3,161,349 | 12/1964 | Schibbye | 418/203 |
| 3,388,854 | 6/1968 | Olofsson et al. | 418/203 |
| 4,878,820 | 11/1989 | Doi et al. | 418/203 |
| 5,207,568 | 5/1993 | Szymaszek | 418/203 |
| 5,816,055 | 10/1998 | Ohman | 62/117 |

FOREIGN PATENT DOCUMENTS

| | | | |
|---|---|---|---|
| 210565 | 6/1984 | Germany | 418/203 |
| 4112991 | 4/1992 | Japan | 418/203 |
| 730977 | 4/1980 | Russian Federation | 418/203 |
| 648055 | 12/1950 | United Kingdom | 418/197 |
| 1325471 | 8/1973 | United Kingdom | 418/203 |

*Primary Examiner*—John J. Vrablik
*Attorney, Agent, or Firm*—Cantor Colburn LLP

[57] ABSTRACT

A compressor in accordance with the present invention includes a male rotor which is axially aligned with and in communication with two female rotors. The compressor includes a housing and a thrust balance configuration. The thrust balance configuration includes a stepped up portion mounted at the suction end of the male rotor and is exposed to fluid from the compressor at high pressure. The outside diameter of the thrust balance configuration is generally less than the crest diameter of the male rotor and sized to provide sufficient area to react thrust loads produced by the first rotor. The thrust balance configuration serves to balance the thrust loads imparted on the male rotor and allows for full axial discharge porting.

10 Claims, 8 Drawing Sheets

MULTI-ROTOR HELICAL-SCREW COMPRESSOR WITH THRUST BALANCE DEVICE

This is a continuation-in-part of copending U.S. patent application Ser. No. 08/808,470, U.S. Pat. No. 5,807,091 entitled MULTI-ROTOR HELICAL-SCREW COMPRESSOR filed Mar. 3, 1997 which is a continuation of Ser. No. 08/550,253, U.S. Pat. No. 5,642,992 filed Oct. 30, 1995 filed by David N. Shaw.

BACKGROUND OF THE INVENTION

The present invention relates to helical screw type compressors. More specifically, the present invention relates to a multi-screw compressor having, e.g., a male rotor and at least two female rotors.

Helical type compressors are well known in the art. One such helical compressor employs one male rotor axially aligned with and in communication with one female rotor. The pitch diameter of the female rotor is greater than the pitch diameter of the male rotor. Typically, the male rotor is the drive rotor, however compressors have been built with the female rotor being the drive rotor. The combination of one male rotor and one female rotor in a compressor is commonly referred to as a twin screw or rotor, such is well know in the art and has been in commercial use for decades. An example of one such twin rotor commonly employed with compressors in the HVAC (heating, ventilation and air conditioning) industry is shown in FIG. 1 herein, labeled prior art. Referring to FIG. 1 herein, a cross sectional view of a male rotor 10 which drives an axially aligned female rotor 12 is shown. Male rotor 10 is driven by a motor, not shown, as is well known. Male rotor 10 has four lobes 14–17 with a 300° wrap and female rotor 12 has six flutes 18–23 with a 200° wrap. The resulting gap between the male and female rotors requires oil to be introduced into the compression area for sealing, however, the oil also provides cooling and lubricating, as is well known. However, the introduction of this oil requires the use of an oil separation device, to separate the oil from the refrigerant being compressed in HVAC compressors. The primary benefit of the twin rotor configuration is the low interface velocity between the male and female rotors during operation. However, the twin rotor configuration is not balanced and therefore incurs large radial bearing loads and thrust loads. The obvious solution to alleviating the bearing load problem would be to install sufficiently sized bearings. This is not a feasible solution, since the relative diameters of the rotors in practice result in the rotors being too close together to allow installation of sufficiently sized bearings.

The prior art has addressed this problem, with the introduction of compressors employing 'so-called' single screw technology. Referring to FIGS. 2 and 3 herein, labeled prior art, a drive rotor 24 with two opposing axially perpendicular gate rotors 26 and 28 is shown. Rotor 24 is driven by a motor, not shown, as is well known. Rotor 24 has six grooves 30 and each gate rotor 26, 28 has eleven teeth 32, 34, respectively, which intermesh with grooves 30. The gate rotors 26 and 28 are generally comprised of a composite material which allows positioning of the gate rotor at a small clearance from the drive rotor. This clearance is small enough that the liquid refrigerant itself provides sufficient sealing, the liquid refrigerant also provides cooling and lubrication. The rearward positioning of gate rotors 26 and 28 and the positioning on opposing sides of drive rotor 24, (1) allows equalizing suction of pressure at both ends of rotor 24 thereby virtually eliminating the thrust loads encountered with the above described twin screw system and (2) balances the radial loading on rotor 24 thereby minimizing radial bearing loads. However, the interface velocity between the gate rotors and the drive rotor are very high. Accordingly, a common problem with this system is the extensive damage suffered by the rotors when lubrication is lost, due to the high interface velocities of the rotors.

One method of overcoming these deficiencies of the prior art is presented in U.S. Pat. No. 5,642,992 commonly assigned to this application. The compressor in '992 includes a male rotor which is axially aligned with and in communication with at least two female rotors. The male rotor is driven by a motor, in other words the male rotor is the drive rotor. The male rotor has a plurality of lobes which intermesh with a plurality of flutes on each of the female rotors. The pitch diameters of the female rotors are now less than the pitch diameter of the male rotor.

The male rotor comprises an inner cylindrical metal shaft with an outer composite material ring mounted thereon. The ring includes the lobes of the male rotor integrally depending therefrom. The lobes of the male rotor being comprised of a composite material allows positioning of the female rotors at a small clearance from the male drive rotor. This clearance is small enough that the liquid refrigerant itself provides sufficient sealing, however, the liquid refrigerant also provides cooling and lubrication.

The positioning of the female rotors on opposing sides of the male rotor balances the radial loading on the male rotor thereby minimizing radial bearing loads. Further, due to a larger diameter male drive rotor as compared to the male drive rotor in the prior art twin screw compressors, and therefore, additional distance between the rotors, any female radial bearing stress can be further minimized with sufficiently sized bearings. It will also be appreciated, that interface velocity between the male and female rotors during operation is very low, whereby the extensive damage suffered by the prior a rt single screw compressors when lubrication is lost, due to the high interface velocities of the rotors, is reduced.

The compressor includes a housing having an inlet housing portion, a main housing portion and a discharge housing portion. An induction side plate and a discharge side plate are mounted on the male rotor. The outside diameter of the induction side plate is equal to the root diameter of the male rotor. The outside diameter of the discharge plate is equal to the crest diameter of the male rotor. These plates serve two purposes, to secure the male rotor components and to equalize suction pressure at both ends of the male rotor, thereby virtually eliminating the thrust loads encountered with the prior art twin screw compressors. It will be appreciated that the discharge plate blocks the axial port area of the male rotor which results in a reduction in overall discharge port area.

SUMMARY OF THE INVENTION

The above-discussed and other drawbacks and deficiencies of the prior art are overcome or alleviated by the multi-rotor compressor of the present invention. In accordance with the present invention, the compressor includes a male rotor which is axially aligned with and in communication with at least two female rotors. The male rotor is driven by a motor, in other words the male rotor is the drive rotor. The male rotor has a plurality of lobes which intermesh with a plurality of flutes on each of the female rotors. The pitch diameters of the female rotors are less than the pitch diameter of the male rotor.

The male rotor comprises an inner cylindrical metal shaft with an outer composite material ring mounted thereon. The ring includes the lobes of the male rotor integrally depending therefrom. The lobes of the male rotor being comprised of a composite material allows positioning of the female rotors at a small clearance from the male drive rotor. This clearance is small enough that the liquid refrigerant itself provides sufficient sealing, however, the liquid refrigerant also provides cooling and lubrication.

The positioning of the female rotors on opposing sides of the male rotor balances the radial loading on the male rotor thereby minimizing radial bearing loads. Further, due to a larger diameter male drive rotor as compared to the male drive rotor in the prior art twin screw compressors, and therefore, additional distance between the rotors, any female radial bearing stress can be further minimized with sufficiently sized bearings. It will also be appreciated, that interface velocity between the male and female rotors during operation is very low, whereby the extensive damage suffered by the prior art single screw compressors when lubrication is lost, due to the high interface velocities of the rotors, is reduced.

The compressor includes a housing having an inlet housing portion, a main housing portion and a discharge housing portion. A thrust balance configuration having a stepped up portion is mounted at the suction end of the male rotor and is exposed to fluid from the compressor at discharge pressure. The minimum outside diameter of the stepped up portion is generally less than the crest, or outside diameter of the male rotor. The thrust balance configuration serves to balance the thrust loads imparted on the male rotor and allows for full axial discharge porting.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DESCRIPTION OF THE PREFERRED EMBODIMENT

Figure 1:
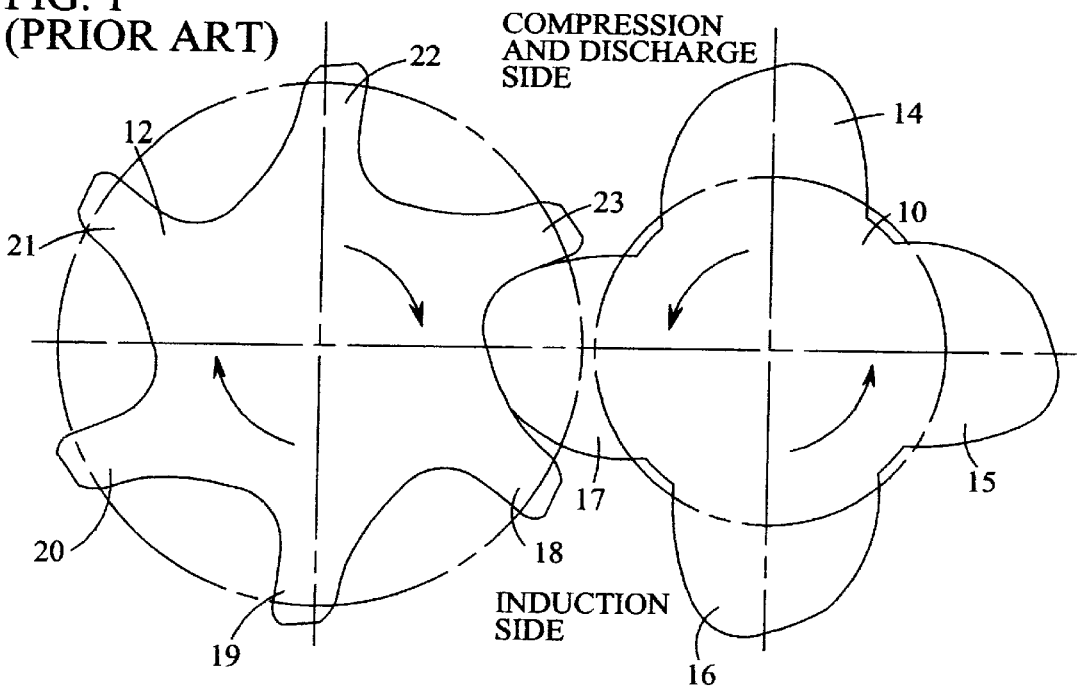
FIG. 1 (PRIOR ART)
FIG. 1 is a diagrammatic cross sectional view of a twin screw or rotor configuration in accordance with the prior art.
Figure 2:
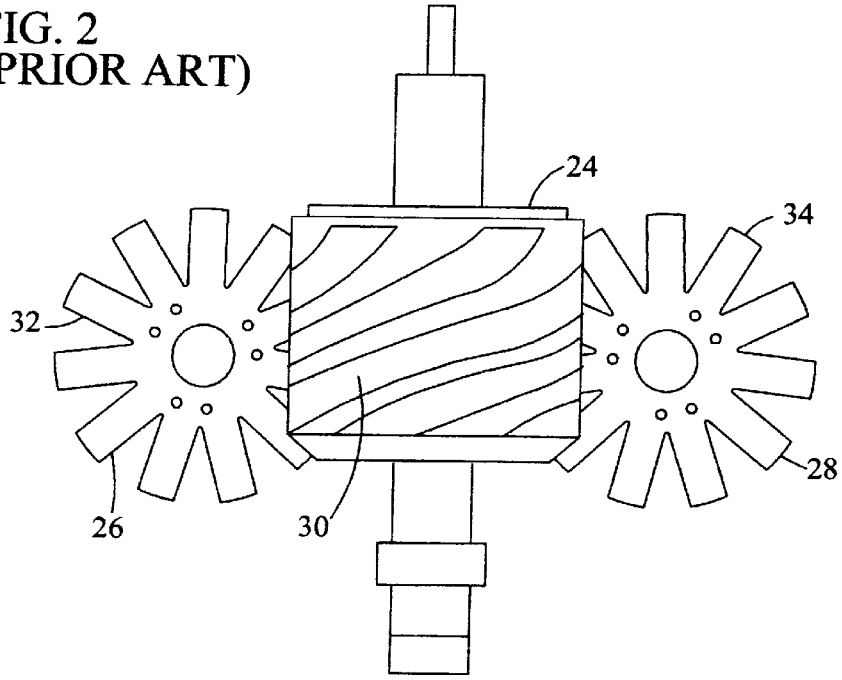
FIG. 2 (PRIOR ART)
FIG. 2 is a diagrammatic top view of a single screw configuration in accordance with the prior art.
Figure 3:
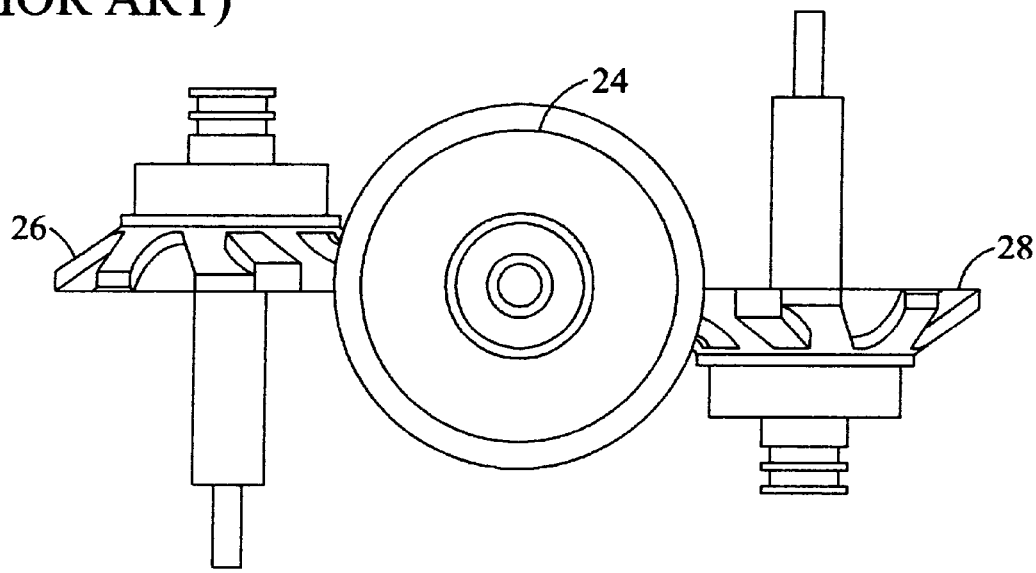
FIG. 3 (PRIOR ART)
FIG. 3 is a diagrammatic end view of the single screw configuration of FIG. 2.
Figure 4:
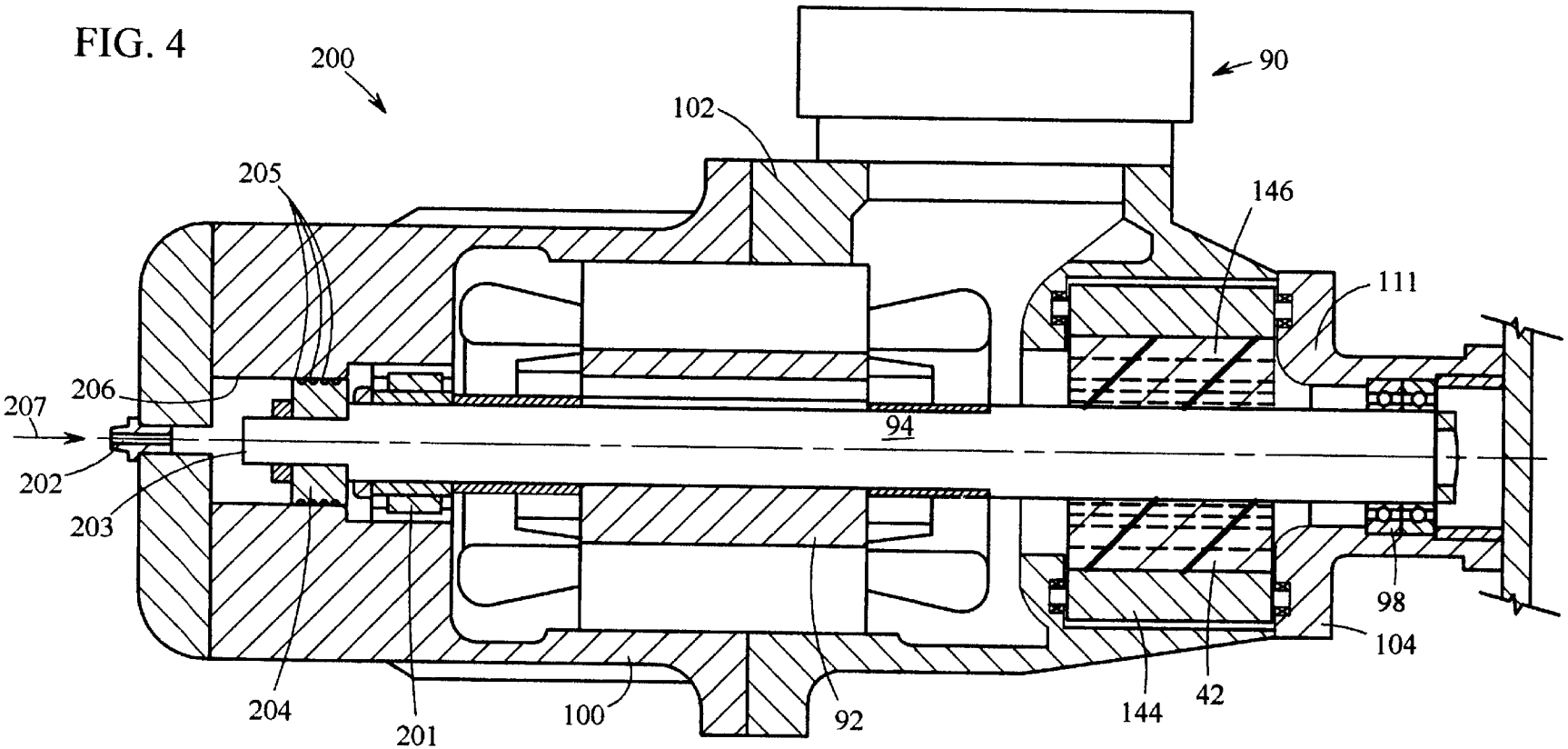
FIG. 4 is a diagrammatic cross sectional view of a multi-rotor compressor and hermetically sealed motor configuration in accordance with the present invention.

Referring to FIG. 4, a cross sectional view of a hermetically sealed motor/compressor system in accordance with the present invention is generally shown at 200. A male rotor 42 is axially aligned with and in communication with female rotors 144 and 146. Male rotor 42 is driven by a hermetically sealed motor 92.

As demonstrated in the prior art, the positioning of female rotors 44 and 46 on opposing sides of male rotor 42 balances the radial loading on male rotor 42 thereby minimizing radial bearing loads. Also, due to larger diameter male drive rotor as compared to the male drive rotor in the prior art twin screw compressors and therefore the additional distance between the rotors, any radial bearing stress can be further minimized with sufficiently sized bearings. It will also be appreciated, that interface velocity between the male and female rotors during operation is very low, whereby the extensive damage suffered by the prior art single screw compressors when lubrication is lost, due to the high interface velocities of the rotors, is reduced. The low interface velocity results in minimal sliding action at the pitch band interface of the rotors.

A bearing 201 is mounted on an overhung portion of shaft 94 near motor 92 and a bearing 98 is mounted at the near end of shaft 94 of compressor 90 to absorb any remaining radial bearing loads. Bearing 98 is shown as a double row angular contact ball type and bearing 201 is shown as a single cylindrical roller bearing. Because of the reduction of radially loading in a multi-rotor compressor of the present invention the respective locations of bearings 98 and 201 eliminates the need for the midshaft bearing of the prior art. Compressor 90 further comprises a housing having a motor housing portion 100, a main housing portion 102, including an intake as is known in the art, and a discharge housing portion 104. Discharge area 111 from compressor 90 comprises porting which communicates with the radial and axial port areas of the rotors, as is well known in the art.

Refrigerant at high pressure (represented by arrow 207) is introduced into the motor housing 100 through port 202. The refrigerant acts on the end 203 of shaft 94 and a stepped up portion of the shaft shown as balance piston 204 to counteract the imbalance force created by the large male rotor as described herein above. It will be appreciated that in order to properly balance the thrust in compressor 90 the total diameter of the balance piston 204 and end 203 is generally less than the crest diameter of the male rotor. In operation of compressor 90 the condensing pressure starts low and builds as does the liquid line pressure of refrigerant 207 introduced at port 202. Balance piston 204 eliminates the need for the discharge side plate of the prior art during normal operation and allows for full axial area discharge.

Balance piston 204 further comprises a labyrinth, or ridges 205, which provide a small clearance between the balance piston and wall 206 of motor housing 100. The small clearance allows fluid 207 to leak past balance piston 204 to provide cooling and lubrication to bearing 201 and further provide cooling to motor 92. During operation, bearing 201 and motor 92 are maintained at low pressure providing a pressure differential which allows fluid to flow from port 202 to the suction side of compressor 90. It will be appreciated that bearing 201 is of a class of bearings requiring little lubrication such as, for example hybrid ceramic bearings.

Prior art bearings require a higher level of lubrication than is generally considered practical for use with the present invention.

Figure 5:
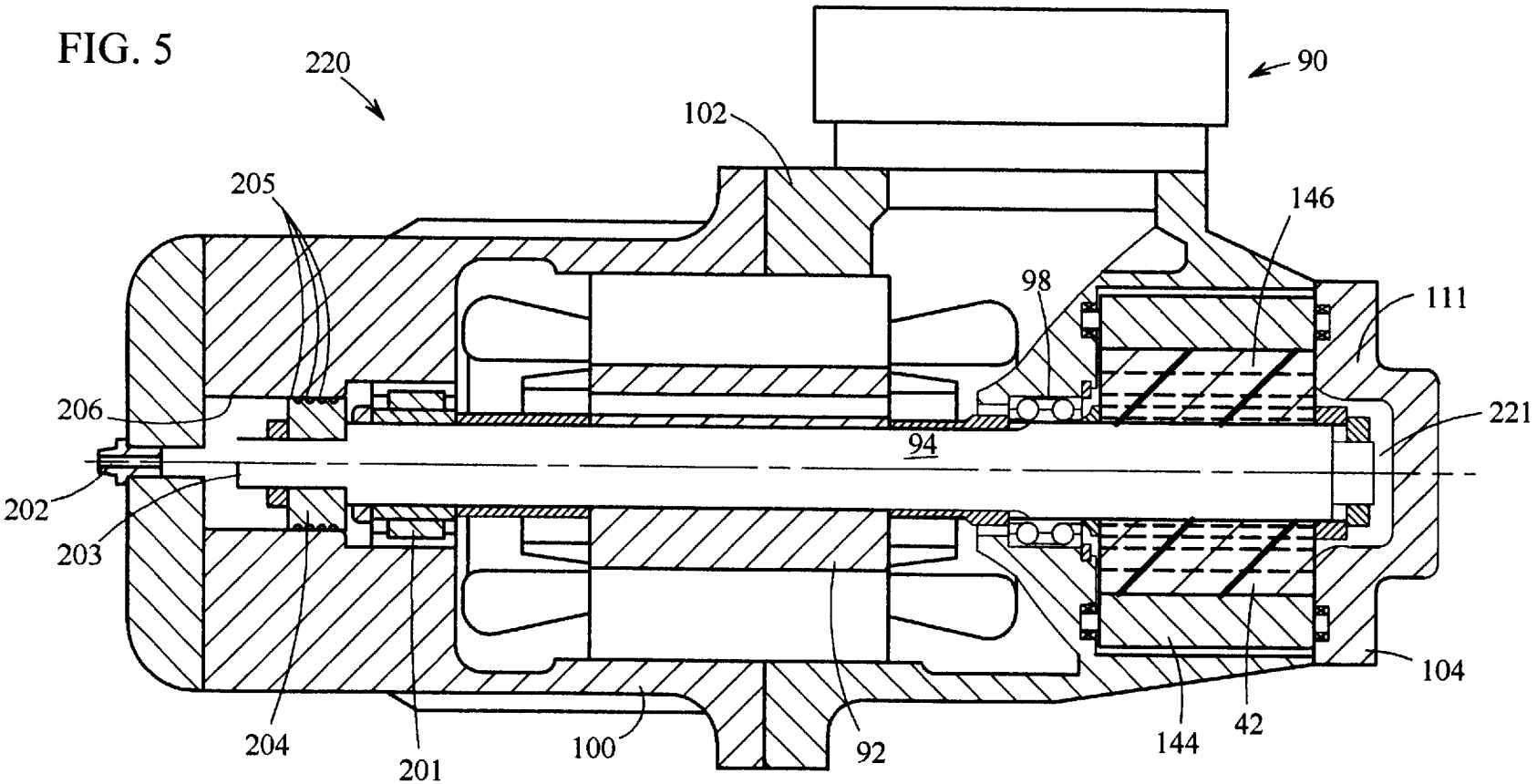
FIG. 5 is a diagrammatic cross sectional view of a multi-rotor compressor and hermetically sealed motor configuration with an overhung male rotor in accordance with the present invention.

With reference to FIG. 5 there is shown an embodiment of a hermetically sealed motor/compressor system 220 according to the present invention having an overhung male rotor 42 of compressor 90. System 220 includes the thrust balance system described herein above to counteract the thrust produced by the large male rotor of the multi-rotor compressor 90 comprising fluid at high pressure reacting against balance piston 204 and shaft end 203. In the embodiment shown bearing 98 is positioned at the suction end of compressor 90 and discharge end 221 of shaft 94 is unsupported. Bearing 98 is shown as a double row angular contact bearing which carries radial as well as axial loading from shaft 94. The positioning of bearing 98 as shown provides for additional space at shaft end 221 for discharge porting.

Figure 6:
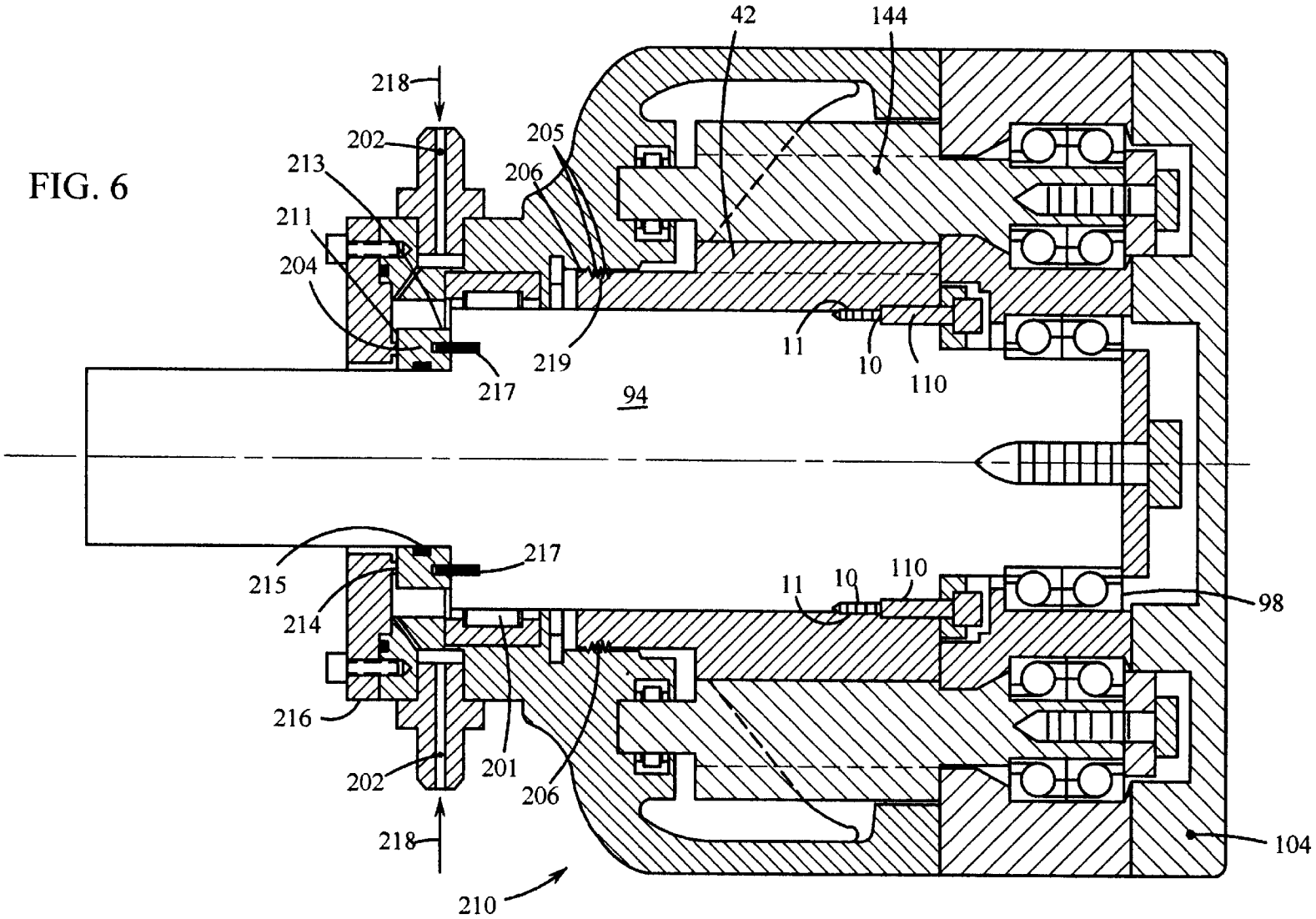
FIG. 6 is a diagrammatic cross sectional view of an open type multi-rotor compressor configuration in accordance with the present invention.

Referring now to FIG. 6, an open type compressor is shown generally at 210 incorporating a thrust balance management system in accordance with the present invention. Compressor 210 is a multi-rotor screw compressor similar to that described herein above in FIG. 4 comprising a induction housing 100, a main housing portion 102 and a discharge housing portion 104. Compressor 210 is shown, by way of example, for an open type air compressor comprising a shaft 94 being driven by an externally mounted motor (not shown). Male rotor 42 is attached to shaft 94 via dowel screws 110 engaged within grooves 10, 11 in the male rotor 42 and shaft 94 respectively and rotates within bearings 98 and 201. Male rotor 42 drives female rotors 144, 146 as is well known in the art. To balance the thrust load, in an open type air compressor, water represented by arrow 218 at high pressure is introduced through ports 202 in induction housing 100 and water 218 reacts against a stepped up portion shown as shoulder 213 of shaft 94 and a ring or shoulder 219 of male rotor 42. Water 218 is prevented from leaking back out of the induction housing 100 by seal 214 located in end plate 216 and seal 215 located in seal piston 204. In the embodiment shown, seal piston 204 rotates with shaft 94 and is mounted thereto by spiral roll pins 217. The area of shoulders 213 and 219 are sized to balance the male rotor thrust load. Compressor 210 is sealed, cooled and lubricated by water and should be noted that bearing 201 is maintained at high pressure and filled with water. Male rotor 42 further comprises a labyrinth, or ridges 205, disposed on the suction end which provide a small clearance between the male rotor 42 and wall 206 of motor housing 100. The small clearance allows water 218, to leak past the labyrinth and enter the suction side of male rotor 42 where it is introduced to the compressor. The discharge side plate of the prior art is no longer needed and axial discharge of the male rotor is thereby permitted.

Figure 7:
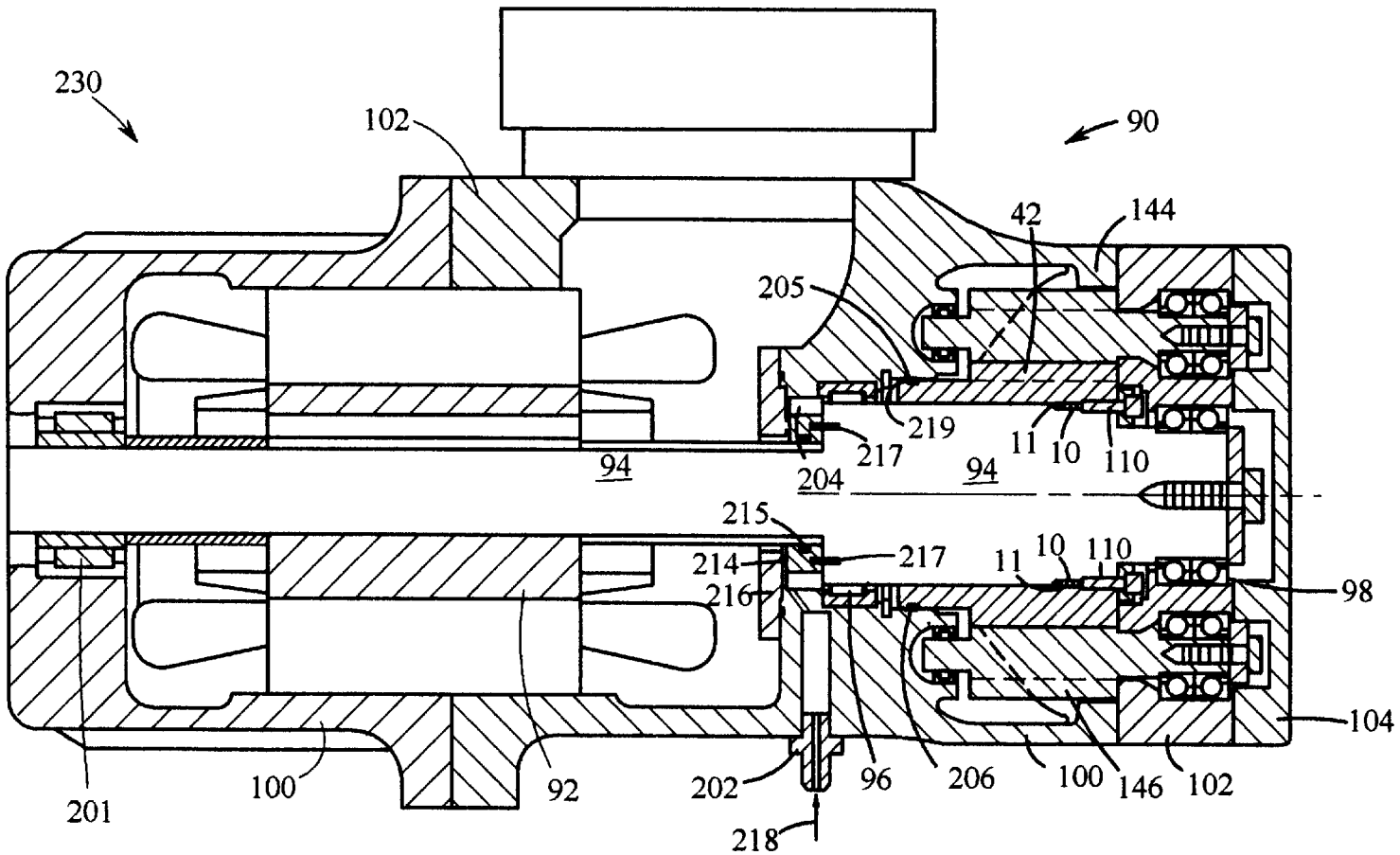
FIG. 7 is a diagrammatic cross sectional view of an integral open type motor and open type multi-rotor compressor of FIG. 6 in accordance with the present invention.

With reference to FIG. 7 there is shown an embodiment 230 of the compressor described in FIG. 6 incorporated within housing 102 with integral open type motor 92. In this embodiment an air and water mixture 218 at high pressure is introduced through port 202 and reacts against shoulders 213 and 219 to counteract the thrust forces produced by male rotor 42 as described herein above for open type compressor 220 of FIG. 6. It is important to note that system 230 further includes bearing 201 which functions, along with bearing 96, to carry radial loads imparted to shaft 94. Bearing 98 carries only thrust loads.

Figure 8:
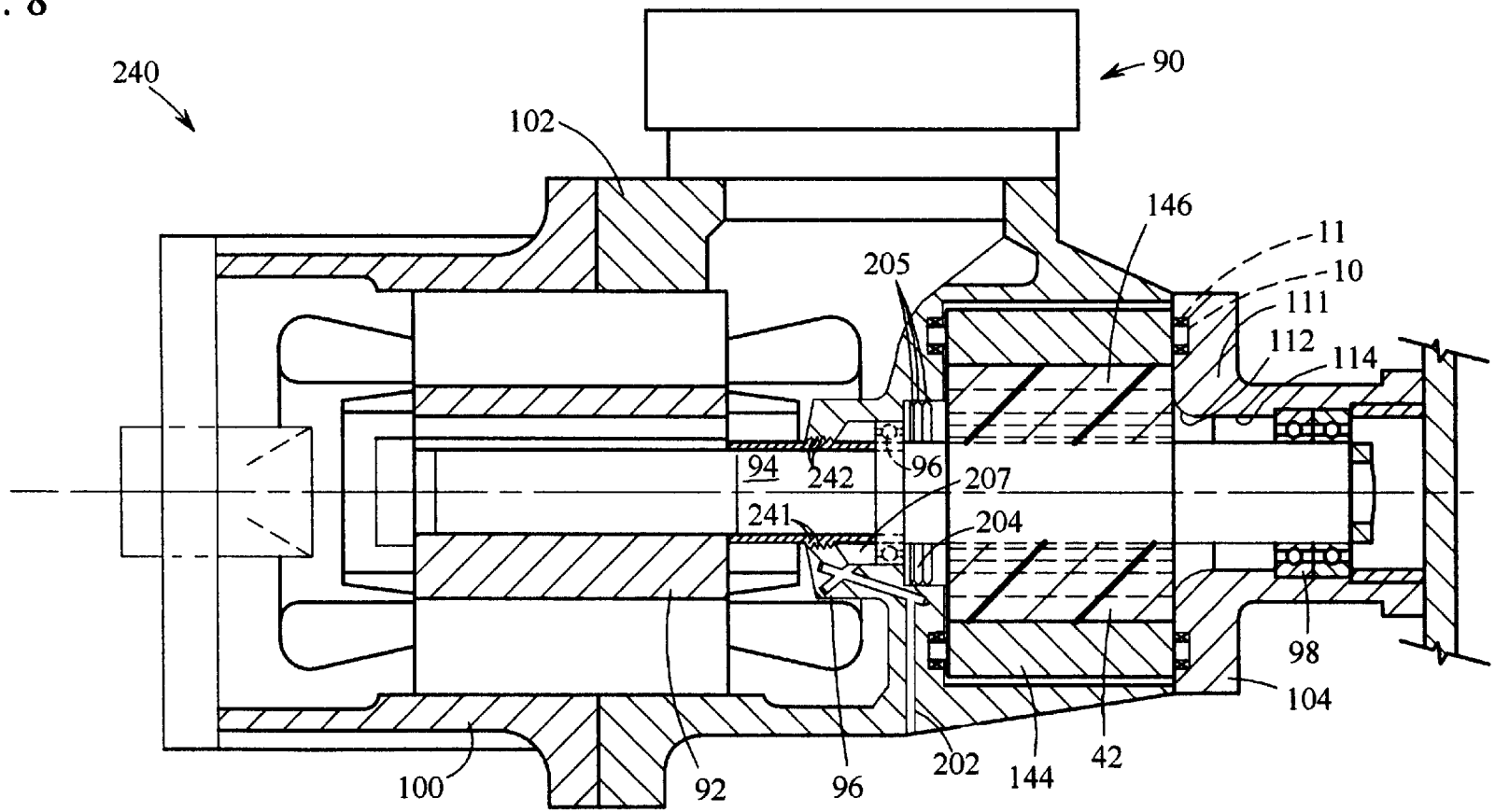
FIG. 8 is a diagrammatic cross sectional view of a multi-rotor compressor and hermetically sealed motor configuration with an overhung motor in accordance with the present invention.

Referring now to FIG. 8 there a hermetically sealed motor/compressor system in accordance with the present invention is shown generally at 240. The system 240 is similar to system 200 described herein above except that motor 92 is overhung and supported by midshaft bearing 96. In the embodiment shown refrigerant at high pressure represented by arrow 207 is introduced through port 202 where a portion passes through bearing 96, reacts against balance piston 204 to balance the thrust load created by male rotor 42 as described herein above. Refrigerant 207 leaks past ridges 205 of balance piston 204 where it is introduced to the suction side of compressor 90 and enters the refrigeration cycle. Ridges 241 of seal 242 allow leakage of refrigerant to the motor housing. Refrigerant which leaks past ridges 241 expands and circulates through motor 92 and enters conduit 243 where it is communicated to the suction side of compressor 90 and enters the refrigeration cycle. Bearing 98 reacts both thrust and radial loads and bearing 96 reacts radial loads from compressor 90 as well as carries the overhung load of motor 92. Ridges 205, 241 may alternatively be located on housing 102 and shaft 94 respectfully without departing from the essence of the current invention.

Figure 9:
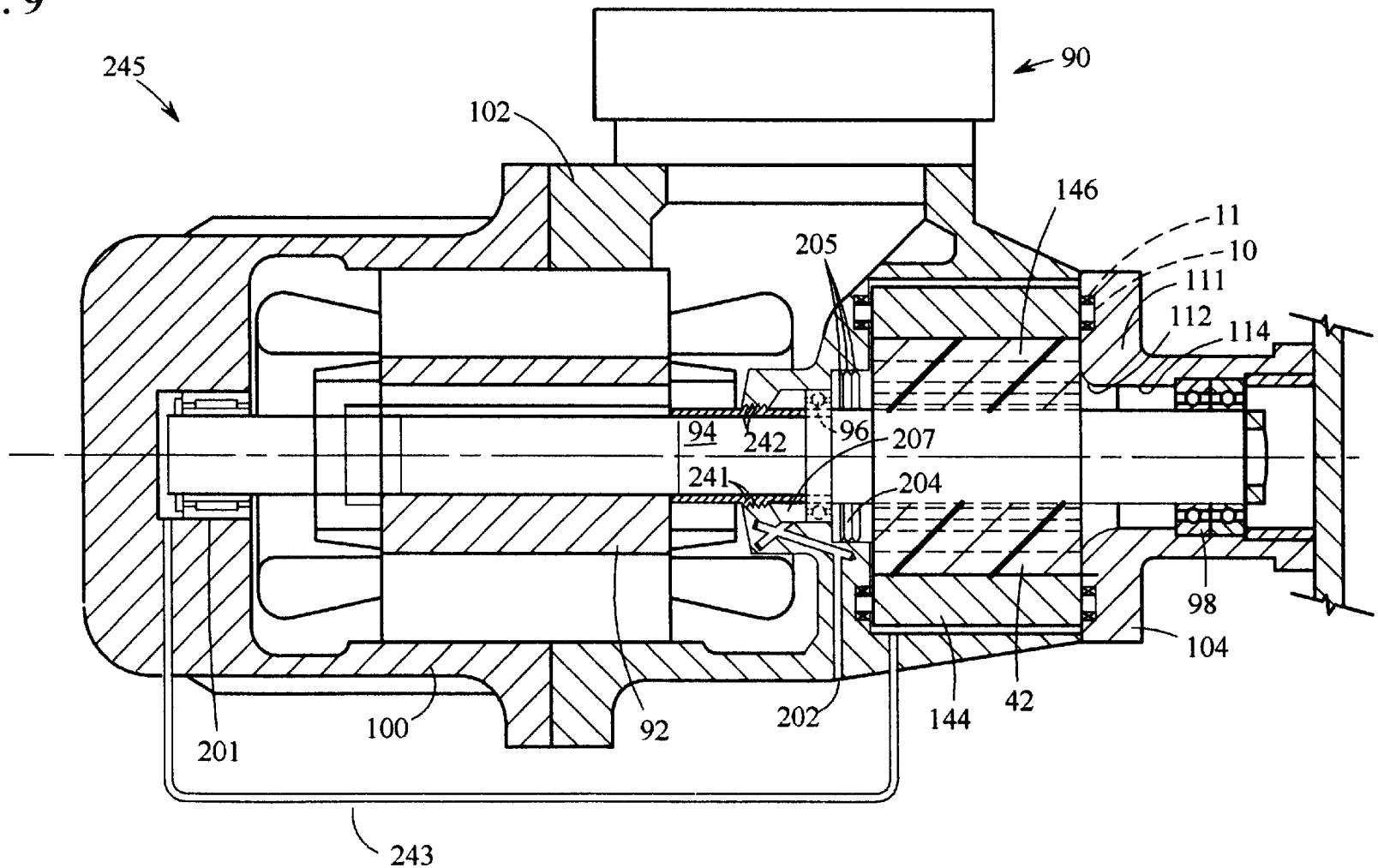
FIG. 9 is a diagrammatic cross sectional view of a multi-rotor compressor and hermetically sealed motor configuration including three shaft bearings in accordance with the present invention.

Referring now to FIG. 9 an embodiment of the present invention is incorporated in a three bearing motor/compressor system 245. The thrust balance system functions similar to that described herein above for the embodiment of FIG. 8 wherein refrigerant 207 reacts against balance piston 204. The system 245 further includes bearing 201 which functions, along with bearing 96, to carry radial loads imparted to shaft 94. Bearing 98 carries only thrust loads. The portion of refrigerant 207 which leaks past ridges 241 further works to lubricate bearing 201 as it expands and circulates within motor housing 100. The three bearing arrangement of system 245 reduces the individual loads on the bearing of a two bearing system which reduces clearances, increases efficiency and increases reliability.

Further, while the above described embodiment has been described with only two female rotors, it is within the scope of the present invention that two or more female rotors may be employed with a single drive male rotor. In addition, while the embodiment shown in FIG. 4 is directed toward a liquid refrigerant type compressor and while the embodiment shown in FIG. 5 is directed toward an air type compressor, it is within the scope of the present invention that either embodiment is suitable for either application and is also applicable in other helical type compressors, e.g., compressors with working fluids such as helium, air and ammonia. Moreover, the multi-rotor compressor of the present invention may be extremely well suited for oil-less air compression.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A helical-screw rotary compressor comprising:

a housing having a discharge end and an opposite end;

a first rotor disposed on a shaft within said housing;

at least two second rotors axially aligned with said first rotor, said first rotor in communication with said second rotors whereby said first rotor drives said second rotors, said second rotors being generally equally spaced about said first rotor;

a discharge port disposed proximate said discharge end of said housing in communication with a discharge port area of each second rotor; and a thrust balance configuration disposed on said shaft proximate said opposite end having at least one stepped up portion, said stepped up portion having a total area sufficient to react a thrust produced by said first rotor.

2. The compressor of claim 1 wherein said housing comprises an inlet port to provide a pressure differential disposed in said opposite end, said inlet port in communication with a high pressure port of said compressor for providing a pressure to said thrust balance configuration.

3. The compressor of claim 1 wherein said thrust balance configuration includes a seal provided between said shaft and said housing and disposed between said inlet port and a suction side of said compressor.

4. A helical-screw rotary compressor comprising:

a housing having a discharge end and an opposite end;

a generally cylindrical shaft rotationally mounted within said housing on at least two bearings;

a first rotor disposed on said shaft proximate said discharge end within said housing;

a drive motor disposed on said shaft for driving said first rotor;

at least two second rotors axially aligned with said first rotor, said first rotor in communication with said second rotors whereby said first rotor drives said second rotors, said second rotors being generally equally spaced about said first rotor;

a discharge port disposed proximate said discharge end of said housing in communication with a discharge port area of each second rotor;

a thrust balance configuration disposed on said shaft having at least one stepped up portion, said stepped up portion having a total area sufficient to react a thrust produced by said first rotor; and said housing including an inlet port in communication with a high pressure port of said compressor for providing a pressure to said thrust balance configuration.

5. The compressor of claim 4 wherein:

said bearings include a first bearing disposed proximate said opposite end and a second bearing disposed proximate a suction side of said first rotor;

said inlet port disposed in said opposite end;

said stepped up portion includes a labyrinth seal disposed on an outer diameter between said stepped up portion and said housing; and said stepped up portion disposed on said shaft between said inlet port and said first bearing.

6. The compressor of claim 4 wherein at least one of said bearings is comprised of a ceramic hybrid bearing.

7. The compressor of claim 4 wherein said stepped up portion has a total outside diameter generally less than the crest diameter of said first rotor.

8. A helical-screw rotary compressor comprising:

a housing having a discharge end and an opposite end;

a generally cylindrical shaft rotationally mounted within said housing on a pair of bearings;

a first rotor disposed on said shaft proximate said discharge end within said housing;

at least two second rotors axially aligned with said first rotor, said first rotor in communication with said second rotors whereby said first rotor drives said second rotors, said second rotors being generally equally spaced about said first rotor;

a discharge port disposed proximate said discharge end of said housing in communication with a discharge port area of each second rotor; and said bearings include a first bearing disposed proximate said opposite end and a second bearing disposed proximate a suction side of said first rotor.

9. The compressor of claim 8 further comprising a drive motor in communication with said shaft for driving said first rotor.

10. The compressor of claim 9 wherein at least one of said bearings is comprised of a ceramic hybrid bearing.

* * * * *